United States Patent [19]

Mamessier

[11] Patent Number: 5,048,794

[45] Date of Patent: Sep. 17, 1991

[54] HYDRAULIC LIFT PERFECTED FOR THE LIFTING AND MANEUVERING OF HEAVY LOADS OF MANY TONS

[76] Inventor: Michel Mamessier, 7, rue Lavoisier, Saint Etienne (Loire), France

[21] Appl. No.: 549,263

[22] Filed: Jul. 6, 1990

[51] Int. Cl.[5] ..... B66F 3/24

[52] U.S. Cl. ..... 254/93 H

[58] Field of Search ..... 254/93 R, 93 H, 13.3, 254/124, DIG. 4; 29/239; 72/705

[56] References Cited

U.S. PATENT DOCUMENTS

| | | | |
|---|---|---|---|
| 2,352,390 | 6/1944 | Kirkland | 254/93 H |
| 2,527,428 | 10/1950 | Kemerer | 254/93 H |
| 4,443,001 | 4/1984 | Haerer | 29/239 |
| 4,886,244 | 12/1989 | Renault | 254/93 H |

*Primary Examiner*—Robert C. Watson

*Attorney, Agent, or Firm*—Weintraub, DuRoss & Brady

[57] ABSTRACT

A hydraulic jack useful in both a horizontal position and a vertical position is disclosed. The jack has a fixed support shoe and a moveable lifting lug which are perpendicularly connected to a column which houses a hydraulically moveable sliding shaft. Hydraulic fluid is stored in a flexible bottle and is fed to a hydraulic pump housed inside a rigid tank, the interior of which constantly communicates with the surrounding atmosphere. The positioning of the flexible bottle with respect to the pump and the communication with the surrounding atmosphere enables the pump to be permanently primed regardless of its orientation.

9 Claims, 4 Drawing Sheets

FIG 3
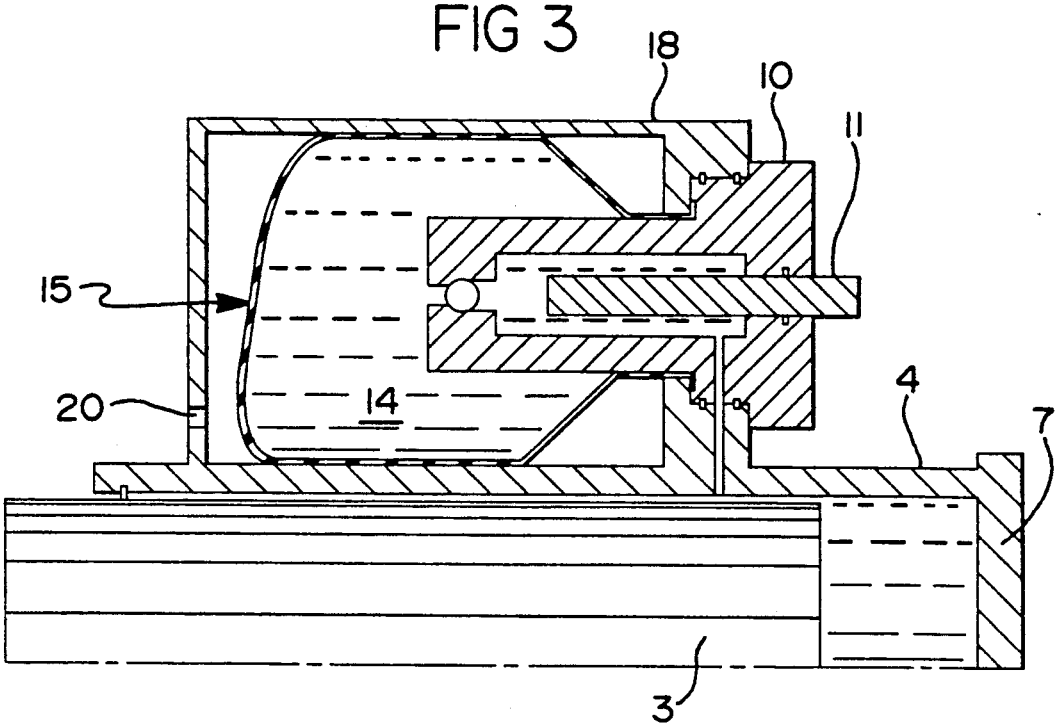
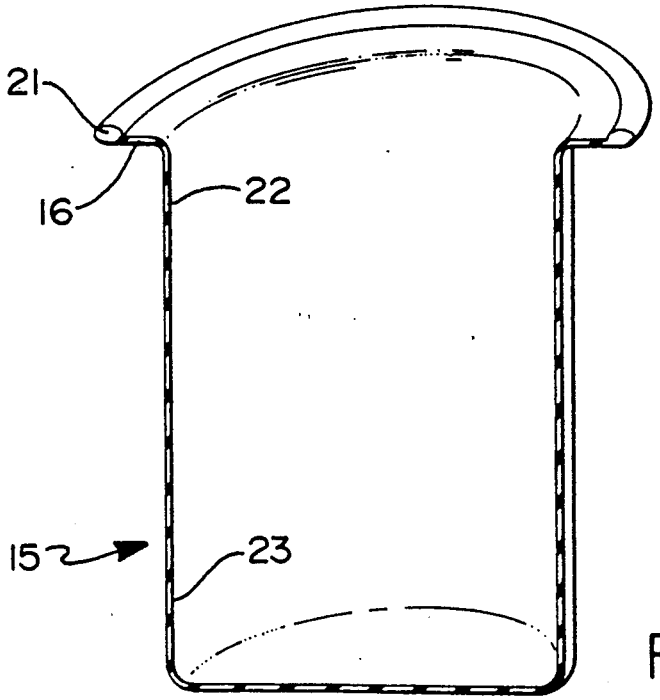
FIG 4

FIG 5
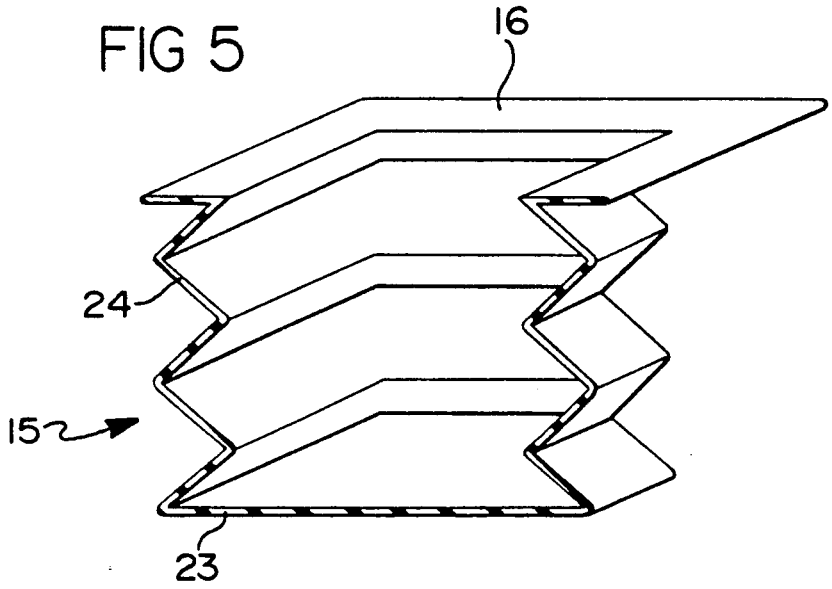
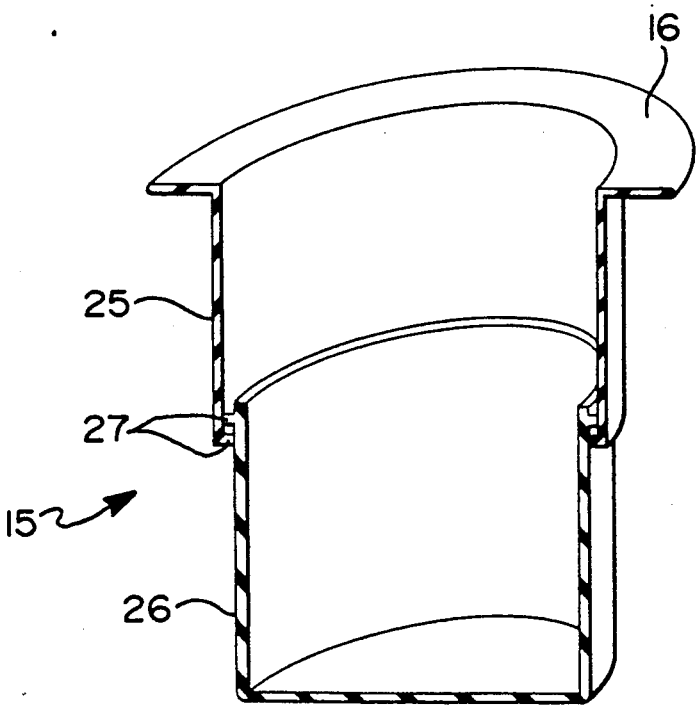
FIG 6

HYDRAULIC LIFT PERFECTED FOR THE LIFTING AND MANEUVERING OF HEAVY LOADS OF MANY TONS

BACKGROUND OF THE INVENTION

1. Field of the Invention

The subject of this invention is an improved hydraulic jack adapted for lifting and handling of heavy loads, for example, of several tons, from the ground up.

2. Prior Art

It is known that hydraulic jacks of this type are capable of lifting loads on the order of 5, 10, 20 tons and more from the ground up. These jacks are arranged to insure holding the load at two possible levels: either by a lug placed on the lower part of the jack, or by the head placed on its upper part, connected to the ram. A gripping handle is made up of a U-profile whose branches are each fastened laterally to the casing in order to permit transport of the jack.

Such hydraulic jack, as produced up to now, operates reliably only when it is used normally in the vertical position. However, the jack is not adapted for use in a horizontal position, since in that case the pump has a tendency to lose its priming.

SUMMARY OF THE INVENTION

The purpose sought by this invention is to remedy this disadvantage by producing a jack that can be used in all positions.

According to this invention, the hydraulic jack consists of a fixed support shoe, both which is connected in a perpendicular direction by a column on which slides a shaft with a lifting lug under the thrust of a hydraulic pump provided with an intake valve for hydraulic fluid, and is characterized in that the hydraulic fluid is contained in a flexible bottle whose variable volume adapts to the volume of fluid held in reserve, the intake valve of the pump being submerged inside this bottle.

In another development of the invention, the assembly of the flexible bottle and the intake portion of the pump is housed inside a fixed rigid tank whose interior communicates permanently with the surrounding atmosphere.

The accompanying drawing, given as a non-limiting example, permits a better understanding of the characteristics of the invention and the advantages which it can provide.

BRIEF DESCRIPTION OF THE DRAWINGS

FIG. 3 is a similar section when it is in the horizontal position.

FIG. 4 is an axial section of the flexible bottle lying down.

FIGS. 5 and 6 are similar sections for two other potential variations for producing the flexible bottle.

DETAILED DESCRIPTION OF THE PREFERRED EMBODIMENT

Figure 1:
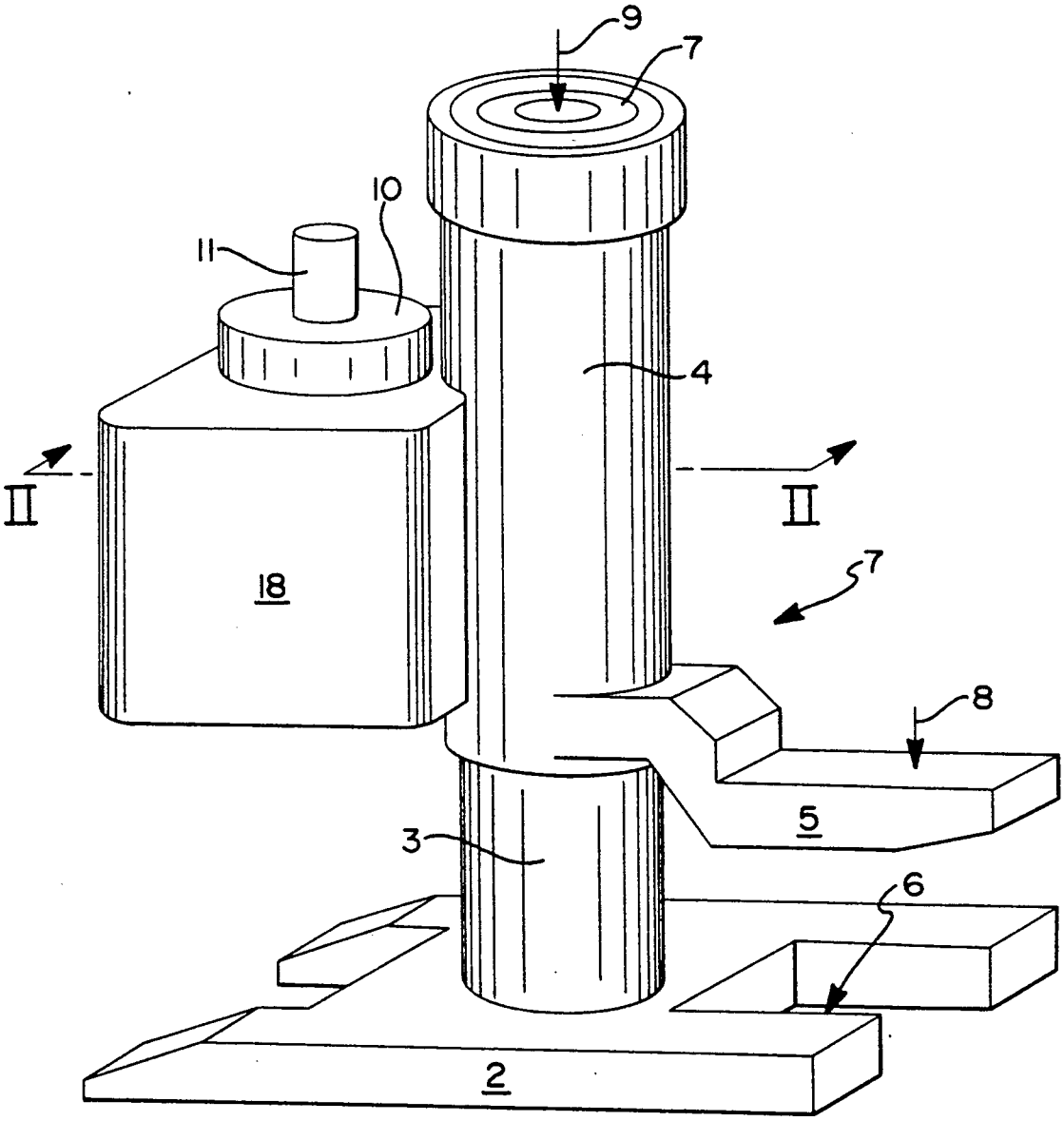
FIG. 1 is a view of the assembly of a hydraulic jack according to the invention.

On the drawings a hydraulic jack 1 is shown, which has a fixed support shoe 2 integral with a perpendicular column 3. A cylindrical shaft 4 slides on this column 3, thus establishing in the usual way a hydraulic lifting jack. The shaft 4 is integral with a lifting lug 5 arranged laterally. In the example illustrated, the lug 5 can be lowered inside of a recess 6 cut out in the shoe 2, into whose thickness it can be retracted, for example in the starting position before lifting anything.

On top, the shaft 4 has a thrust face 7, so the hydraulic jack 1 has two usable lifting points, depending on the situation, that is:

a lifting point 8 on the support face of the lug 5.

a lifting point 9 made up of the thurst face 7.

Advance of the lift ram 3, 4 is insured in the usual way, starting with a hydraulic pump, shown in the figure only as the body 10 and the piston 11. The piston is driven in the usual way, for example commencing with a beam having an alternating movement, not shown.

The pump assembly 10, 11 is fastened laterally to shaft 4.

According to the invention, the intake valve 12 of the pump 10, 11 is located on the "lower " part of the body 10 (that is, at the end of body 10 which is the one closer to the shoe 2). Furthermore, the intake valve assembly 12 and that of corresponding part 13 of the pump body 10 is submerged in a hydraulic fluid 14 held in a flexible bottle 15. The latter has on top a clamping flange 16 that locks upon mounting between the top of the pump body 10 and a transverse support face 17 that is integral with shaft 4.

In all cases, the flexible bottle 15 is filled with liquid 14 without leaving any space for air bubbles or gas of any kind. This arrangement insures that the intake valve 12 is constantly submerged in the hydraulic fluid 14, whatever the jack orientation.

Finally, for protection, the flexible bottle 15 as well as the intake portion 13 of the pump 10, 11 is housed inside of a fixed rigid tank 18. Cavity 19 of this tank 18, inside of which is found the bottle 15 and the intake portion 13, is permanently connected to the surrounding atmosphere. For this, it is provided with a free air vent 20, for example, cut out of the tank wall 18.

Figure 2:
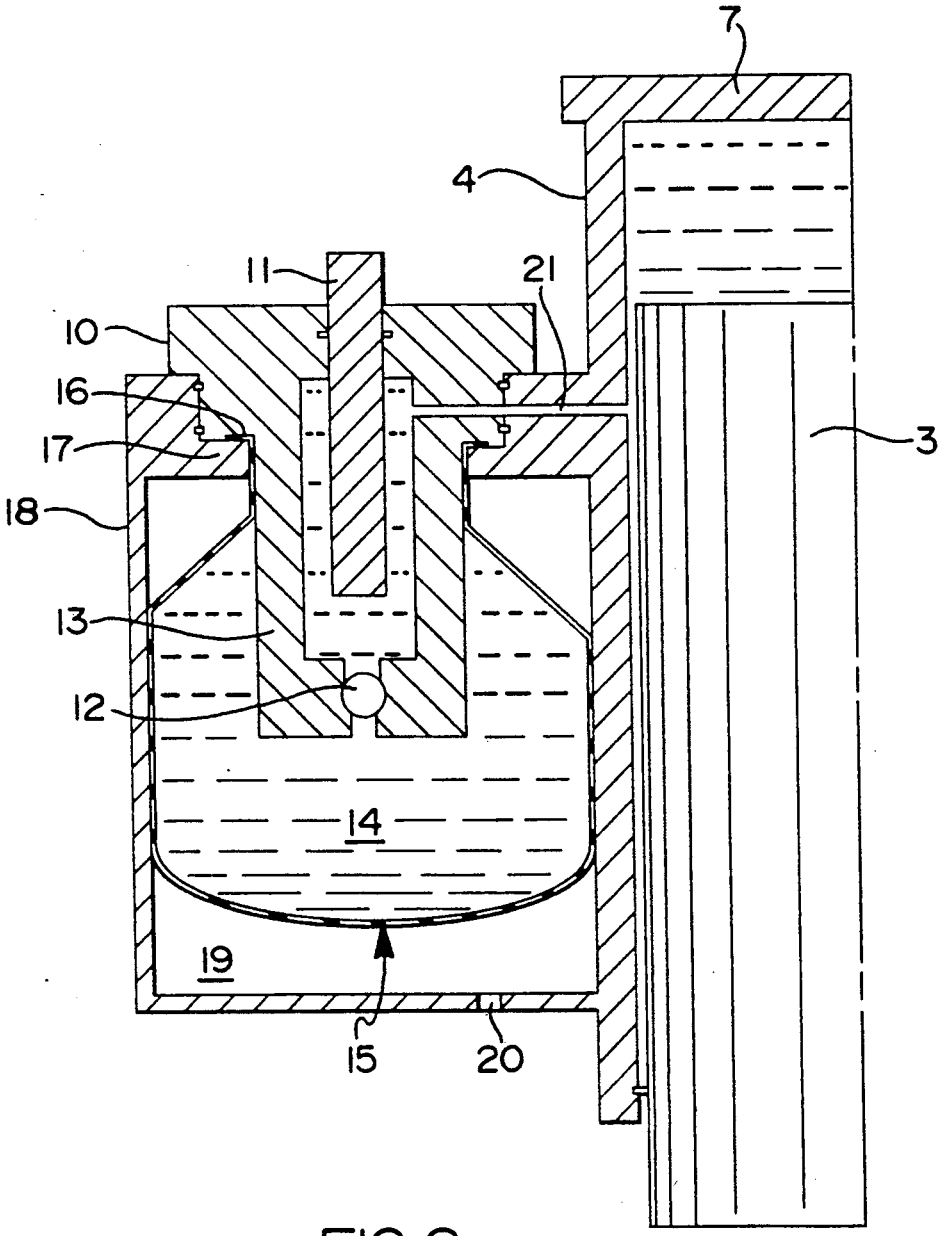
FIG. 2 is a partial section along II—II (FIG. 1) showing the arrangement of internal components when it is in the vertical position.

The operation is as follows:

When the jack 1 is a vertical position (FIGS. 1 and 2), the bottle 15 occupies the position shown in FIG. 2. The intake portion 13 is submerged in the fluid 14 and when the pump piston 11 is actuated in the usual way, the delivery line 21 permits feeding the ram 3, 4. Supported on its shoe 2, the jack 1 is now usable for lifting a load placed on one or the other of its lifting faces 8, 9.

If, on the other hand, the jack 1 is placed in a horizontal position (FIG. 3), the bottle 15 deforms under the effect of static load of hydraulic fluid 14 but the extent of this deformation is limited by the presence of rigid tank walls 18. In any event, it can be seen that the valve 12 and the intake portion 13 remain permanently submerged in hydraulic fluid 14. Furthermore, however much of this fluid is drawn off by the pump 10, 11, the portion of the volume corresponding to the intake is compensated by deformation of the bottle 15. Thus, the pump 10, 11 can never lose its priming.

Of course, the bottle 15 can be made of various materials, which allow a great amount of deformation. For example, it could be made of latex or of a nitrile chemically compatible with the hydraulic fluid 14.

In the variation shown in FIG. 4, the bottle 15 has a generally cylindrical form (cylinder of revolution). The flange 16 is circular, bordered by a peripheral sealing bead (or rim) 21. Furthermore, the thickness of the cylindrical wall in zone 22 of the flange 16 is greater than the thickness of wall 23 in other areas of the bottle.

In the variation shown in FIg. 5, the peripheral flange 16 has a square or rectangular contour. This is attached to the flat bottom 23 by a body 24 made in the form of a bellows (or boot).

Finally, in the case of the variation of FIG. 6, the flexible body of the bottle 15 is made up of an upper enclosure 25 and a lower enclosure 26 both of cylindrical shape. These two enclosures slide, one on the other, and the leak-tightness of their sliding junction is insured by the seals 27.

I claim:

1. A hydraulic jack usable in a vertical or horizontal position comprising:

(a) a jack body having:

(1) a column, (2) a base section comprising a fixed support shoe integral with the column, (3) a cylindrical shaft having a top lifting section and a bottom lifting section, the column being located within the shaft and being slidable therein.

the bottom lifting section comprising a movable lifting lug attached perpendicular to the shaft;

(b) a hydraulic system in fluid communication with the shaft comprising:

(1) a flexible bottle having a bottom wall the bottle being adapted to contain fluid, the bottle collapsing as fluid exits the bottle.

(2) a rigid tank integral with the shaft for housing the flexible bottle.

(3) a hydraulic pump housed within the bottle, the pump comprising:

(a) a body having an intake valve submerged within the bottle;

(b) a piston; and (c) a fluid delivery line for delivering fluid from the pump to the shaft, and wherein the flexible container collapses toward the pump as fluid exits the bottle such that fluid is always available to the intake valve.

2. The hydraulic jack of claim 1 wherein the flexible bottle further comprises a clamping flange for mounting the bottle to the pump body and within the tank.

3. The hydraulic jack of claim 2, wherein the flexible bottle further comprises:

a peripheral sealing bead bordering the clamping flange, and wherein the flange is cylindrical.

4. The hydraulic jack of claim 2, wherein the clamping flange comprises a generally rectangular frame, and the flexible bottle comprises a bellows and a flat bottom wall, the bellows being connected to the frame.

5. The hydraulic jack of claim 2 wherein the flexible bottle has two sections, the first section of the bottle being slidable within the second section as fluid in the bottle exits, and the bottle further comprises at least one seal located at the sliding juncture of the first section and the second section.

6. The hydraulic jack of claim 7 which comprises a liquid disposed in the flexible bottle, the liquid substantially completely filling the bottle.

7. The hydraulic jack of claim 1 wherein the support shoe has a recess formed therein for receipt of lifting lug.

8. The hydraulic jack of claim 1 wherein the rigid tank further comprises a transverse support face for receipt of the clamping flange of the flexible bottle.

9. The hydraulic pump of claim 1 wherein the rigid tank further comprises at least one vent located therein in a permanently open position.

* * * * *